US010508015B2

(12) United States Patent
Nini

(10) Patent No.: US 10,508,015 B2
(45) Date of Patent: Dec. 17, 2019

(54) DELIVERING TAP MADE OF PLASTIC MATERIAL FOR CONNECTING SYSTEMS EQUIPPED WITH AUTOMATIC CLOSURE

(71) Applicant: Vitop Moulding S.R.L., Alessandria (IT)

(72) Inventor: Diego Nini, Alessandria (IT)

(73) Assignee: Vitop Moulding S.R.L., Alessandria (IT)

( * ) Notice: Subject to any disclaimer, the term of this patent is extended or adjusted under 35 U.S.C. 154(b) by 0 days.

(21) Appl. No.: 15/774,691

(22) PCT Filed: Sep. 28, 2016

(86) PCT No.: PCT/IT2016/000222
§ 371 (c)(1),
(2) Date: May 9, 2018

(87) PCT Pub. No.: WO2017/081708
PCT Pub. Date: May 18, 2017

(65) Prior Publication Data

US 2018/0319651 A1 Nov. 8, 2018

(30) Foreign Application Priority Data

Nov. 13, 2015 (IT) ..... UB2015A005533

(51) Int. Cl.
*B67D 3/04* (2006.01)

(52) U.S. Cl.
CPC ..... *B67D 3/042* (2013.01); *B67D 3/043* (2013.01)

(58) Field of Classification Search
CPC ..... B67D 3/042; B67D 3/043
(Continued)

(56) References Cited

U.S. PATENT DOCUMENTS 2,192,530 A * 3/1940 Tottereau ..... B67D 3/043 141/226
4,687,123 A * 8/1987 Hyde ..... F16K 21/04 222/518

(Continued)

FOREIGN PATENT DOCUMENTS

DE 202013100900 6/2014
WO 0198158 12/2001

OTHER PUBLICATIONS

International Search Report dated Jan. 20, 2017 pertaining to co-pending PCT International Application No. PCT/IT2016/00022—4 Pages.

(Continued)

*Primary Examiner* — Kevin L Lee
(74) *Attorney, Agent, or Firm* — McCarter & English, LLP

(57) ABSTRACT

A tap (1) for delivering liquids from a container is described, comprising a supporting body (4) with fitting means (4.8) with the container, and connecting means (4.7) connected to connecting means present on a connector (7); a central pin (3) connected to a central geometry (4.10) of the supporting body (4) and comprising at an end thereof a fastening geometry (3.1) and at an opposite end an abutment geometry (3.3) for opening the connector (7) when it is connected to the tap (1); a membrane-type elastic sealing valve (6) for the automatic closure of the tap (1) and its operating sealing with the main body (4); a control member (5) to open and close the tap (1) transmitting a force to the valve (6) connected to the control member (5).

10 Claims, 19 Drawing Sheets

(58) Field of Classification Search
USPC ..... 137/614.03, 614.04; 251/149.1, 149.6
See application file for complete search history.

(56) References Cited

U.S. PATENT DOCUMENTS

| | | | | |
|---|---|---|---|---|
| 5,477,883 | A | 12/1995 | Totten | |
| 6,892,760 | B2 * | 5/2005 | Roos et al. | B67D 1/0835 137/614.03 |
| 8,776,828 | B2 * | 7/2014 | Koo et al. | F16L 37/36 137/614.03 |
| 2004/0238778 | A1 | 12/2004 | Wrigley | |
| 2013/0292592 | A1 | 11/2013 | Py | |

OTHER PUBLICATIONS

Written Opinion dated Jan. 20, 2017 pertaining to co-pending PCT International Application No. PCT/IT2016/000222—5 Pages.

* cited by examiner

DELIVERING TAP MADE OF PLASTIC MATERIAL FOR CONNECTING SYSTEMS EQUIPPED WITH AUTOMATIC CLOSURE

CROSS REFERENCE TO RELATED APPLICATIONS

This application is a national stage application filed under 35 USC 371 of PCT/IT2016/000222, filed Sep. 28, 2016, which claims the benefit of Italian Patent Application No. UB2015A005533, filed Nov. 13, 2015, all of which is incorporated herein, in its entirety, by reference.

FIELD OF THE INVENTION

The present invention refers to a delivering tap of liquids from containers, in particular the so-called containers of the "bag-in-box" type (herein below called BIB). In particular, the invention relates to a delivering tap completely made of plastic material, which can be adapted to connecting systems existing on the market, equipped with automatic closure by means of an elastic element, preferably a dome, whose purpose, coupled with a main body, will also be performing the main seal of the tap and minimizing the amount of air entering the "Bag in Box" after filling the container, minimizing the oxidation of the product contained inside the bag.

Purpose of the present invention is creating a tap which is completely made of plastic material (therefore, easily recyclable) and which can be adapted to connectors present on the market, actually replacing an old version of tap currently marketed by companies like Rapak (UK), which is part of the international DS Smith Packaging company.

BACKGROUND OF THE INVENTION

Various tap configurations are known in the art, produced by company Rapak (UK) (shown for example in FIGS. 18 and 19, which are known embodiments of this product).

In any case, there are also other similar configurations of a known type, related to taps actuated by connectors having similar principles to those of the above mentioned tap, for example marketed by companies ITW New Zealand Limited (US-A1-2004238778) and Rieke Corp (U.S. Pat. No. 6,378,742).

All known taps listed above have approximately a similar operating/actuating principle, namely, with reference to FIG. 18:

- step 1: screwing-type connectors 7 present on the market;
- step 2: screwing the connector 7 onto a body 14.3 of the tap 14;
- step 3: internal thrust of the connector with an OR-ring 13, which will perform an operating sealing onto the internal walls of the upper part of the tap (an opposite threading) 14;
- step 4: the bit 8.1 of an internal peg 8 to the connector 7 will centrally push a central actuator 14.1 of the tap, which will free the outlet hole of liquid from the tap present on the body 14.3; the central actuator 14.1 will move by a preset height till it blocks itself on a plane element or surface of the body 14.3, and at that time the central actuator 14.1 will operate as fixed abutment to open the centre of the internal peg 8 and free the connector passage, creating an open channel between connector and tap;
- step 5: behind the central actuator 14.1 of the tap a metallic spring 14.2 is assembled (or the actuator itself will have the shape of an elastic dome, supported also by a metallic spring therein) which allows its automatic closure (following the reverse cycle to the one described above), allowing to take back the two systems, connector and tap, to their closing position.

Such taps however have some defects. For example, some of them are not completely made of plastic material, but make use of metallic springs therein (as occurs for the Rapak (UK) tap) to enable the tap, once disconnected from the connector, to go back to its closing position avoiding liquid leakages.

The presence of a metallic spring in a set of plastic pieces makes the tap not eco-compatible in terms of recycling, unless one decides to disassemble every single tap, differentiating plastic from metal.

The element of the main body is further complex to be able to create the stable seat of the metallic spring, or anyway of the spring elements present on the plug itself.

This highly increases the manufacturing and building costs of the die, in addition to those for assembling the piece.

The flow of such taps is often limited by the fact that the opening elements of the tap 14 itself and of the connector 7, and namely of the central actuator 14.1 and the internal peg 8, being both in a central position, will "clog" the passage of liquids, strongly increasing the flow from the system.

SUMMARY OF THE INVENTION

Object of the present invention is providing a simple and eco-compatible taps which however allows it to be adapted to connectors present on the market, not requiring any modification and changing the actuating system, making it unique and universal for all marketed connectors (in the case shown in FIG. 9, a connector 7 of company Britvic, UK). The known connectors 7 of company Britvic present on the market are so far three, and the inventive tap will have to be able to be adapted without problems with a single solution to all connector versions.

The connector 7 will have to be screwed by means of a threading present both on the main body or the supporting body of the inventive tap, and on the connector itself, and perform a seal onto the internal walls of the inventive plug. Simultaneously, by means of the thrust of the connector, which will "descend" when screwing it onto the tap inside the tap itself, the inventive tap will have to be opened, which then, however, in turn will have to open the liquid passage of the connector, creating an open channel for passing the liquid. Everything will be better explained below, where the differences between the inventive tap 1 and the known tap 14 marketed by company Rapak will be better described, pointing out advantages and differences one with respect to the other.

The present invention will further have to solve the above prior art problems, by providing an improved delivering tap which is made with a minimum number of parts, is equipped with an internal sealing membrane, which is the main member of the tap, and which allows performing both automatic closing and opening operations of the tap without the use of metallic springs, and a greater seal to oxygen, also due to the high-seal elastomeric material of which it is composed, in addition to prevent/decrease the oxidation of liquid inside, since the inventive tap, with respect to those present on the market, strongly decreases the amount of air entered into the BIB due to its special elements, all contained in the rear part of the plug, actually removing/occupying spaces which are usually free, and therefore, consequently, occupied by air which will be entered into the bag after its filling (in the plugging step).

Another object of the present invention is providing a tap as described above, which performs a sealing of the valve made of elastomeric material on the body, thereby obtaining a high increase of oxygen barrier. The improvement of the oxygen barrier is also obtained due to the fact that the closure is directly performed onto the body disk, removing leakages due to the various parts exposed outwards; moreover, all system members are housed, for such purposes, on the back of the tap with respect to the delivering area to decrease the outward exposure (and therefore decrease the entry of oxygen particles and to occupy space in the tap back in order to decrease the space allowed for air).

The inventive tap, being equipped with a high oxygen barrier, is adapted for aseptic applications, and therefore for aseptic treatments, which, sometimes, can be damaging and therefore cannot be applied to some types of known taps, since their dispenser must be subjected to sterilizing cycles with hot steam, or gamma rays, or distilled water or other agents (also mutually associated), which in some cases are aggressive, impairing the closure operation.

The element with disk with which the body is equipped, immediately orients the tap in its correct position, strongly facilitating the manufacturers of containers, above all of the bag type, which manage to assemble the tap onto the mouth immediately in its correct position.

The inventive tap is equipped, on its back, with a counterfeit-preventing device, which will be coupled with a similar element present on the connecting mouth (not shown), in order to make the inventive tap unmovable, once inserted onto the mouth (after filling the bag).

The above and other objects and advantages of the invention, as will appear from the following description, are obtained with a delivering tap as claimed in claim 1. Preferred embodiments and non-trivial variations of the present invention are the subject matter of the dependent claims.

It is intended that all enclosed claims are an integral part of the present description.

BRIEF DESCRIPTION OF THE DRAWINGS

The present invention will be better described by some preferred embodiments thereof, provided as a non-limiting example, with reference to the enclosed drawings, in which.

DETAILED DESCRIPTION OF PREFERRED EMBODIMENTS

Figure 1:
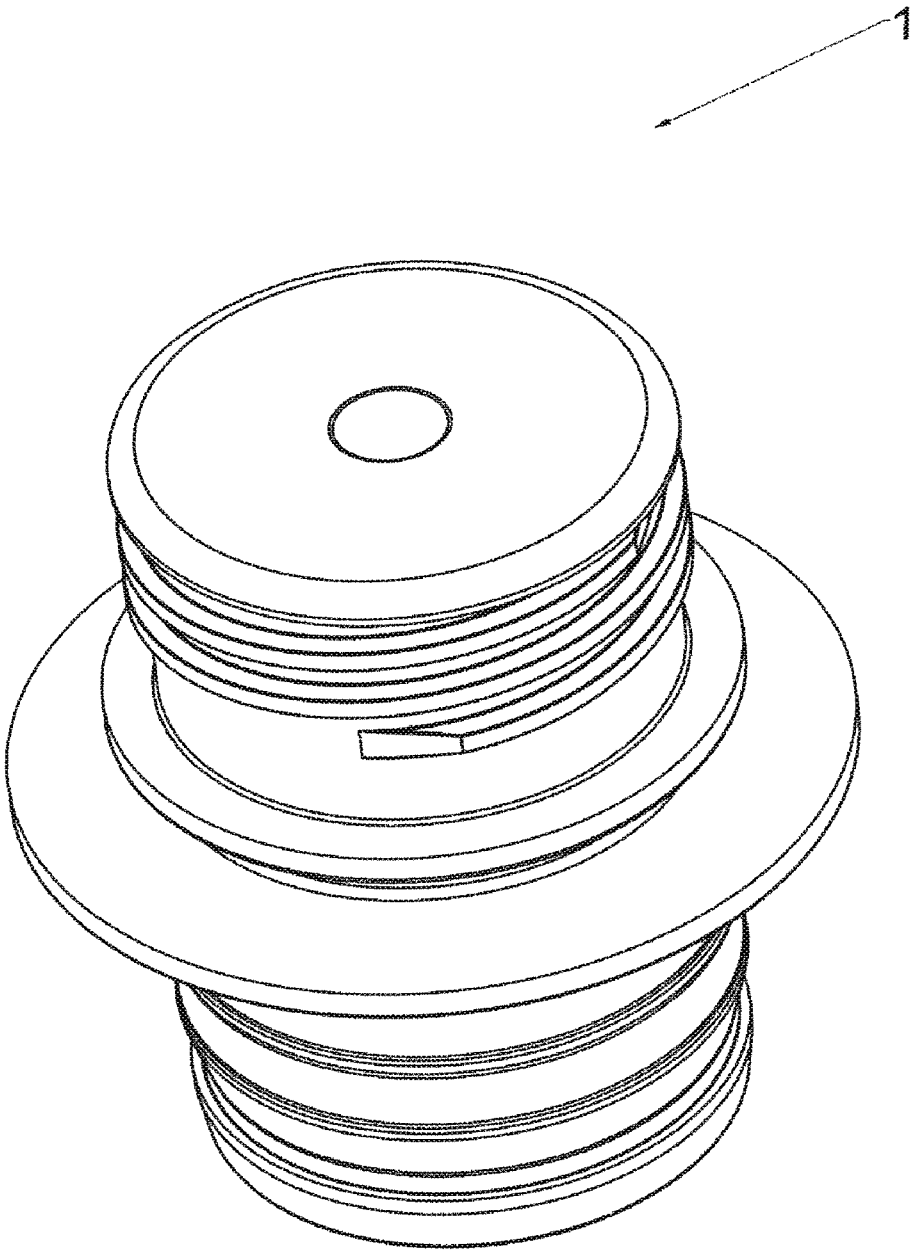
FIG. 1 is a perspective view of an embodiment of the tap according to the present invention.
Figure 2:
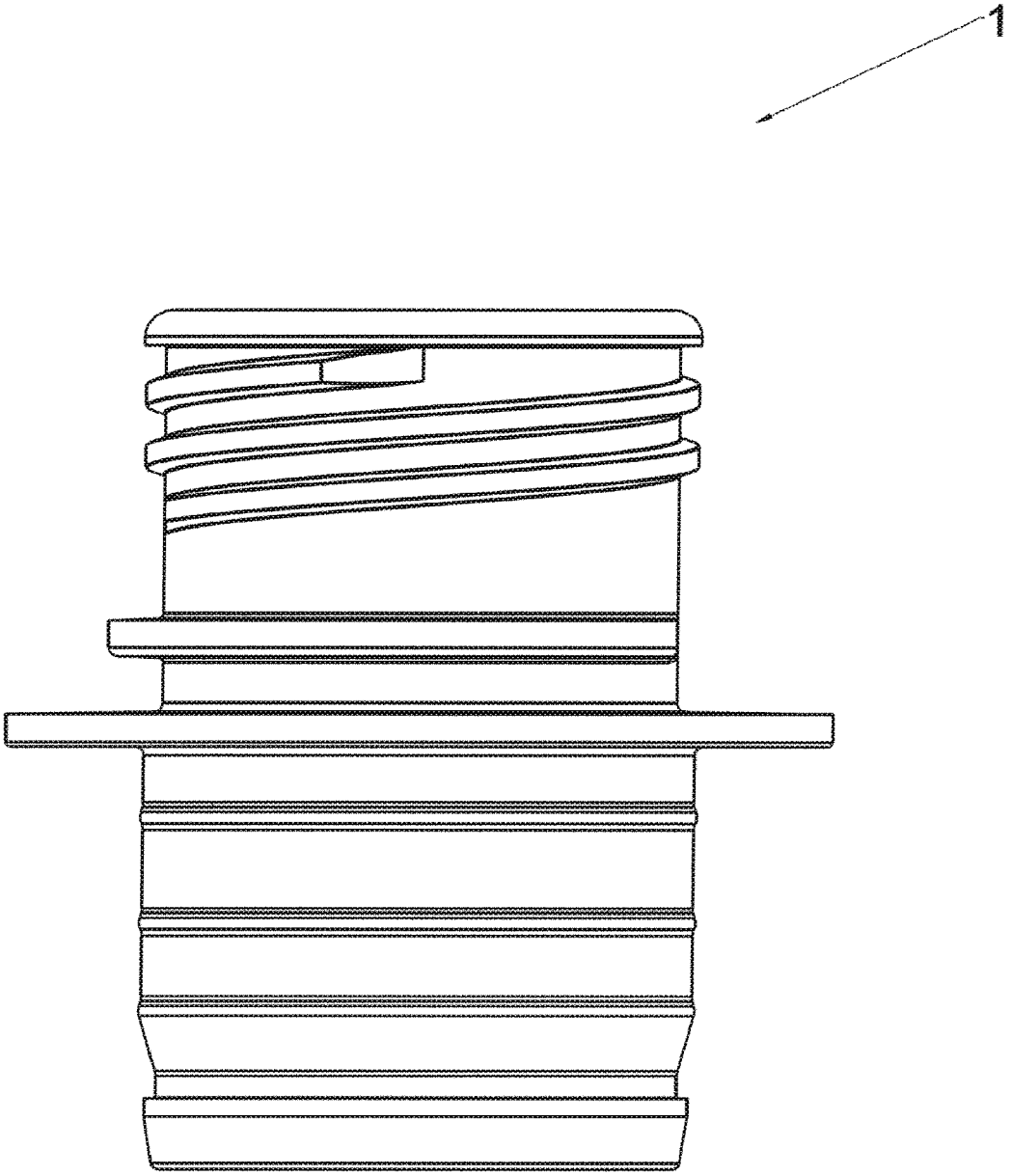
FIG. 2 is a side view of an embodiment of the tap according to the present invention.

With reference to the Figures, an example and non-limiting embodiment of the delivering tap 1 of the present invention is shown and described. It will be clear to a skilled person in the art that the described tap can be made with equivalent shape, sizes and parts, and can be used for various types of containers, for example the so-called "Bag-in-Box", but also those of the rigid or semi-rigid type or others.

The tap 1 of the invention is used for delivering liquids from a container (not shown), and substantially comprises:

- an elongated cylindrical supporting body or main body 4 equipped at an end with fitting means 4.8 with the container and adapted to be closed, at an opposite end, with an upper closing plug or element 2; such supporting body 4 is equipped with at least one first opening 4.5 for the liquid to go out, and is equipped with connecting means 4.7, for example an external threading, adapted to be connected with connecting means, for example the same threading, present on the connector 7. Preferably, the fitting means are composed of sealing rings 4.8 made on the opposite end to the threading, which will be operatively connected to the connecting mouth (not shown), which in turn will be welded to the bag of the BIB and will operate as connecting element between the tap and the bag of the BIB. In a preferred way, the supporting body 4 comprises a ring 4.9*a* with sharp edge, which will operate as removal-preventing abutment of the tap once having inserted it in the connecting mouth (not shown). A central element or central cylinder 4.10 will be present inside the supporting body 4, which will be used as guide/seat of a central pin 3. Internal elements or connecting ribs 4.9, preferably shaped as a cross, are present, adapted to mechanically support the central cylinder 4.10 on which the central pin 3 will be assembled. Preferably, outside of the supporting body 4, a complete disk 4.3 and an orienting element 4.4 of the tap are present, and inside there will be an area with slanted wall 4.2, which will be used as main sealing area of the inventive tap 1;
- the central pin 3 has an elongated shape, is connected to the central element or central cylinder 4.10 and comprises at an end a fastening element 3.1 of an elastic sealing valve 6 and at the opposite end an abutment element 3.3, which, as will be described, generates the opening of the connector 7 in its operating step, once this latter one is operatively connected to the inventive tap 1;

a membrane-type elastic sealing valve 6, preferably comprising a dome-shaped membrane, which will be operatively connected to the central pin 3 by means of the fastening element 3.1 connected to a sealing element 6.3 by the elastic sealing valve 6. In turn, the valve 6 will be connected to a control member or movement stem 5 by means of a tooth element 6.1 on a groove element 5.1 of the control member 5, as will be described below. The dome-type elastic valve 6 of the tap 1, in addition to allow automatically closing, will perform the operating sealing with the main body 4 of the same by means of an external element or external edge 6.2, which will be coupled with the area with slanted wall 4.2 of the main body 4;

the control member (or movement stem) 5 for opening and closing the tap 1, operatively connected to the elastic valve 6, preferably by means of the tooth element 6.1 on the groove element 5.1, and which is adapted to be actuated through a thrust of a plane 10.1 (FIG. 9) of the connector 7 on end elements 5.2 with which the control member 5 is equipped. The control member 5 is equipped with a flexible element or flexible wings 5.7, preferably with four "arms", at whose ends there are the end elements 5.2. Every single "arm" is equipped with a projection 5.4 which is used to create a plane on which the plane 10.1 of the connector 7 will rest, and will allow discharging the force till the valve 6 connected to the control member 5, allowing to open the tap 1. Preferably, inside every single arm, there is a rib 5.5 which is used to provide a structure to the piece. The control member 5 further comprises a tapered element 5.6 which can be used, at will, as sealing plane of the cylinder of the sealing element 6.3 on an inclined plane of the tapered element 5.6;

at least one upper closing element or plug 2, which will be operatively coupled, by interference, with the supporting body 4, and will be used to hygienically protect the tap during all steps which precede the operating connection between inventive tap 1 and connector/s 7.

Figure 10:
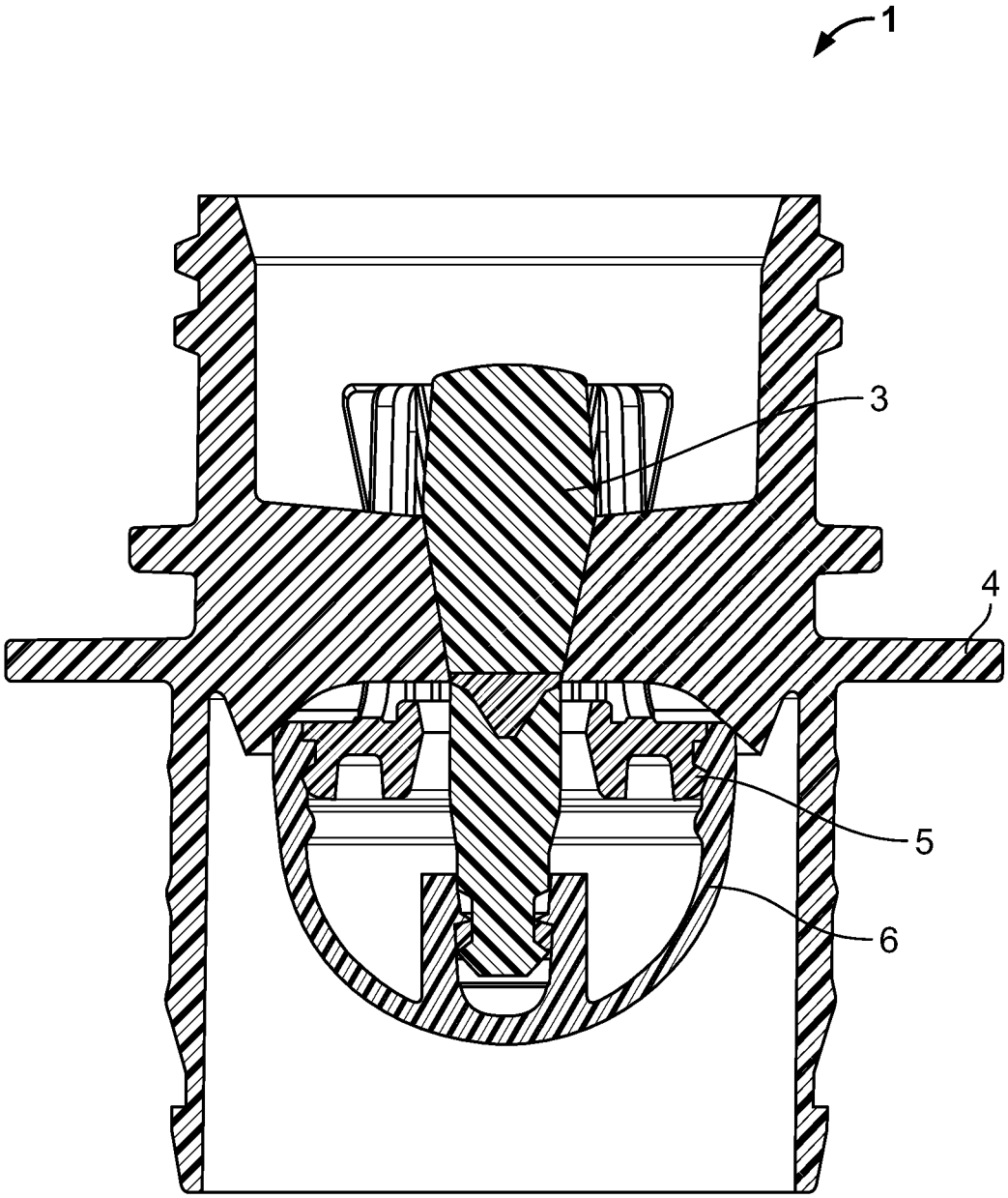
FIG. 10 is a sectional view of the inventive tap once having disconnected the connector in a closing position.
Figure 11:
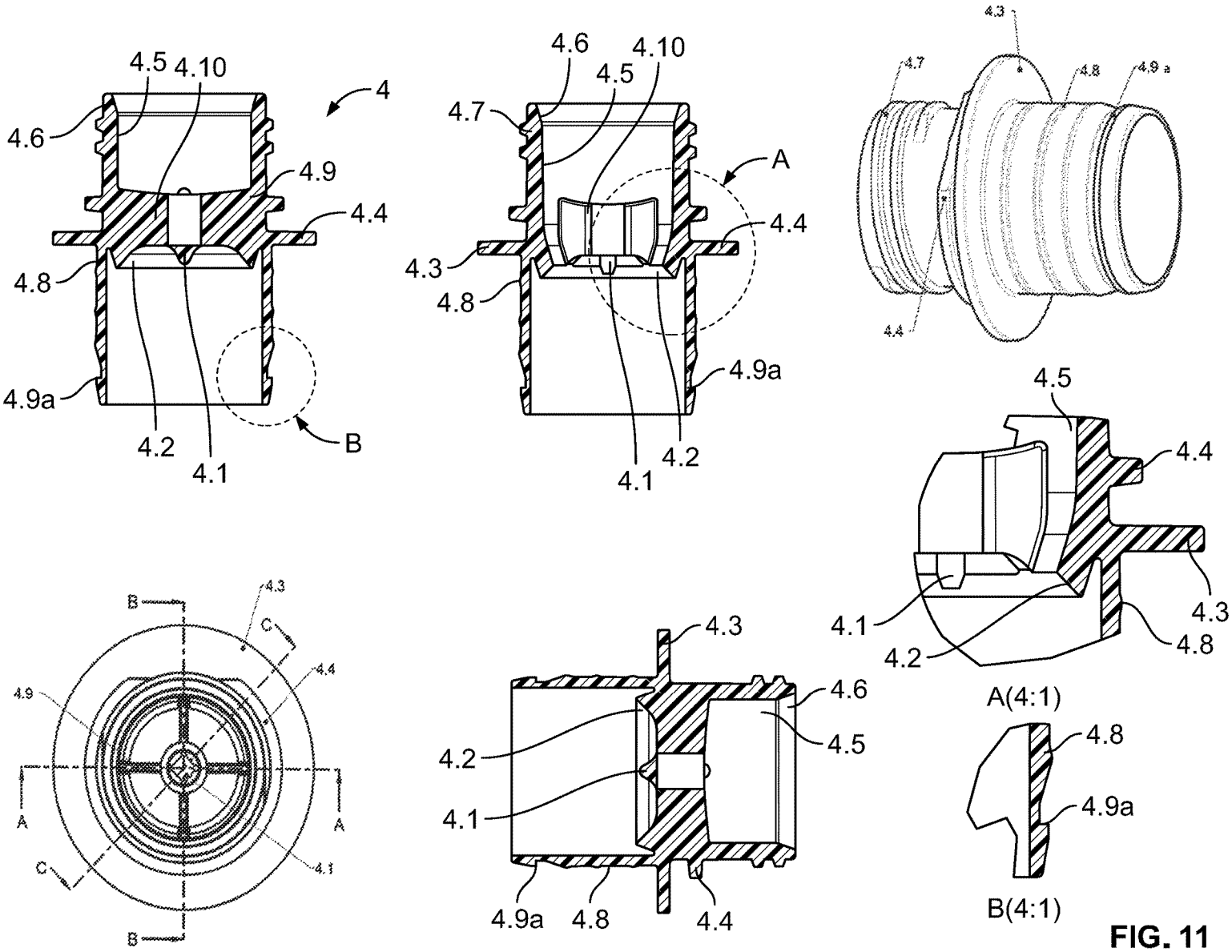
FIG. 11 shows views of a main body or supporting body of the inventive tap in different positions and with different details.
Figure 12:
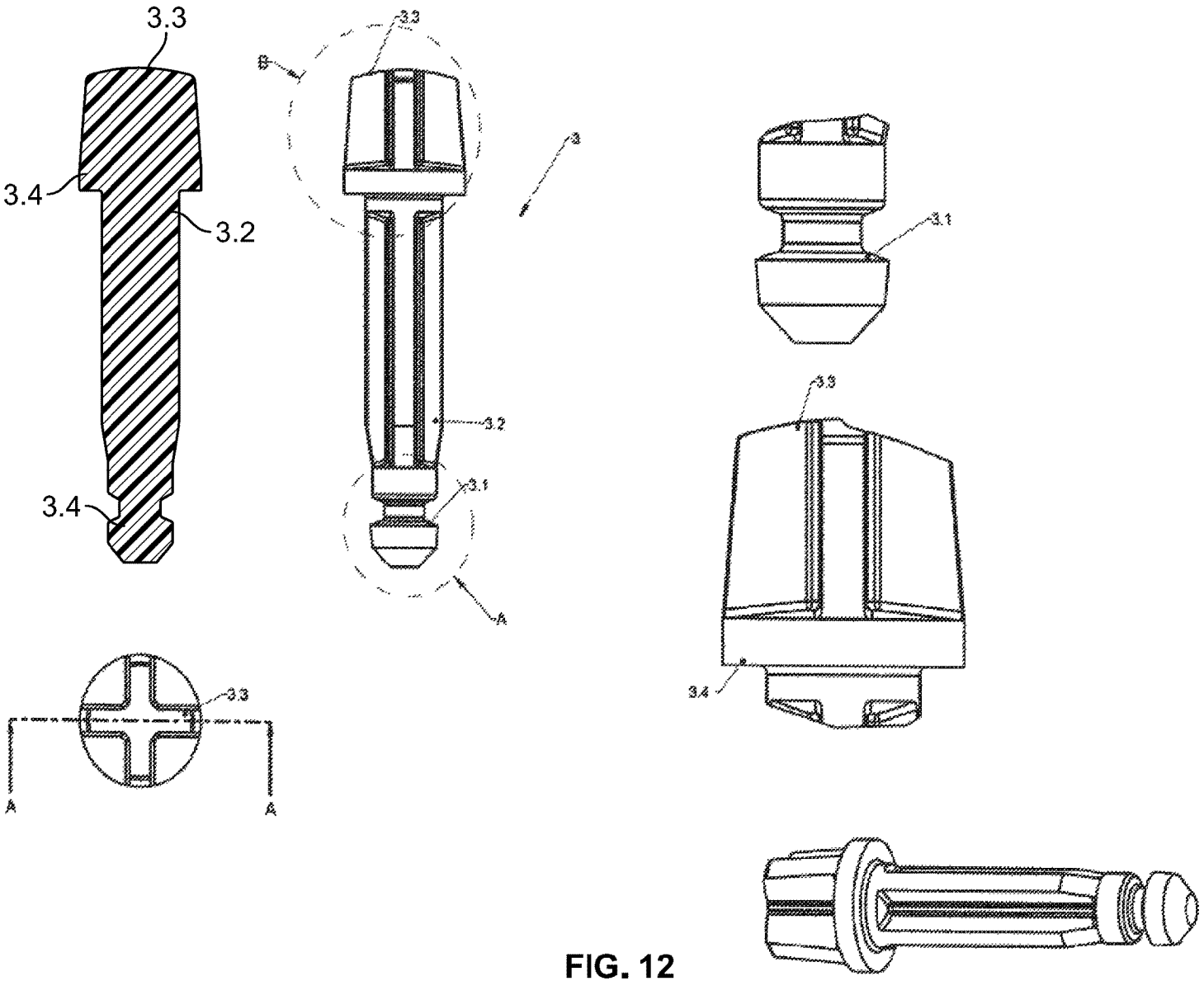
FIG. 12 shows views of a central pin of the inventive tap in different positions and with different details.
Figure 13:
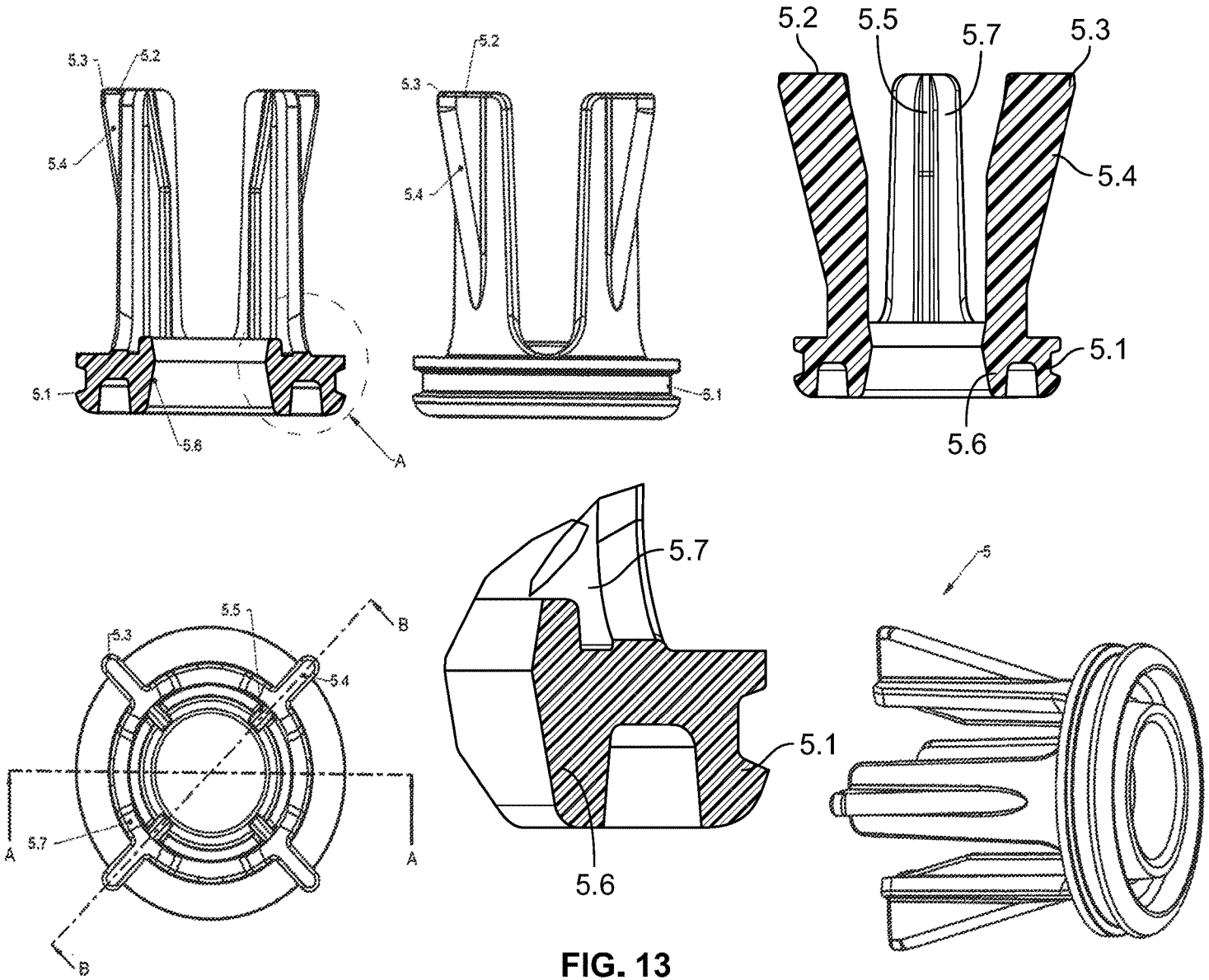
FIG. 13 shows views of a movement stem of the inventive tap in different positions and with different details.
Figure 14:
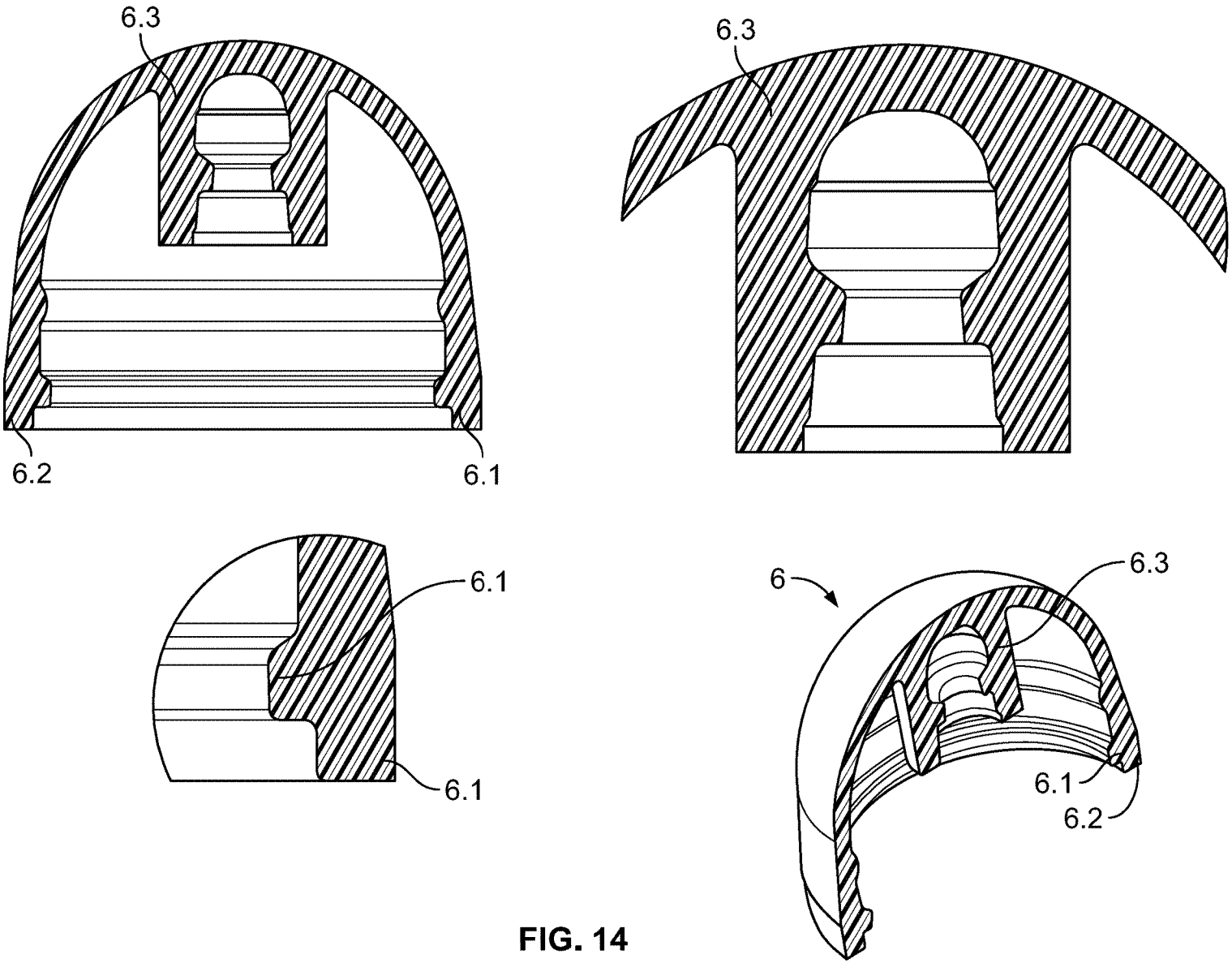
FIG. 14 shows views of an elastic sealing valve of the inventive tap in different positions and with different details.

In particular, with reference to FIG. 10, the tap 1 is shown in section, but in a closing position, and it can be noted that the main body 4 is inserted into the suitable central cylindrical element 4.10 obtained in the body 4 itself, after having removed, in this version, an injection sprue 4.1. The central cylinder 4.10 is supported, and will discharge the load generated by the thrust of the internal peg 8, in particular of its surface 8.1, of the connector 7 during the opening step on the central pin 3 of the tap 1, by the connecting ribs 4.9, preferably shaped as a cross. These latter ones will discharge the force on the upper part of the main body 4 on the wall of the first opening 4.5. The control member 5 for opening/closing will be assembled with flexible wings 5.7. The membrane of the dome-type valve 6 will be operatively connected to the control member 5, due to the groove elements 5.1 with the tooth element 6.1. In turn, the assembly created by the control member 5 and the dome-type valve 6 will be operatively connected, by means of the sealing elements 6.3 and the fastening elements 3.1, to the central pin 3 of the tap 1.

Figure 9:
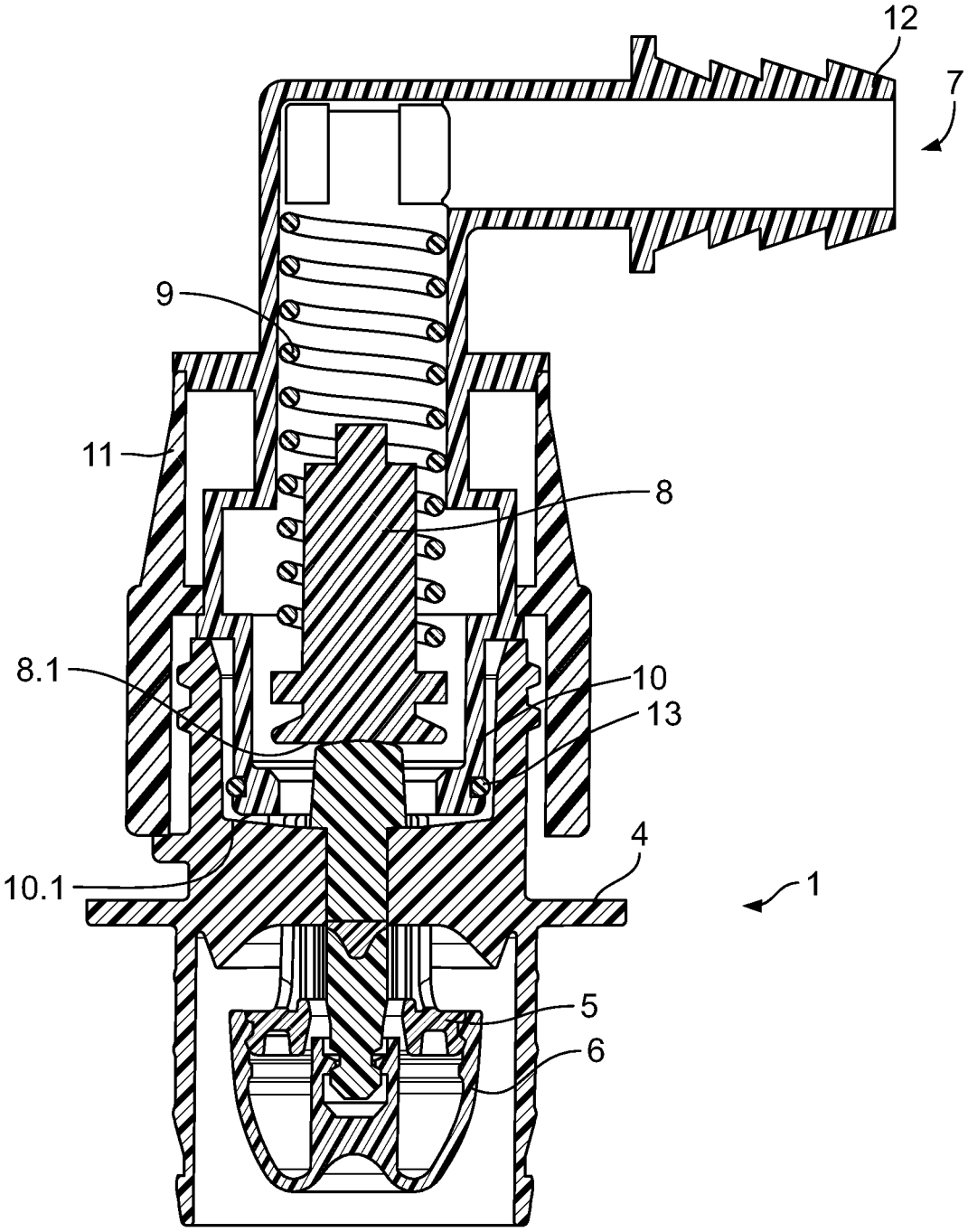
FIG. 9 is a side sectional view of the inventive tap connected and in an operating position with the connector.

With reference to FIG. 9, the connection is shown by means of the threading present both on the inventive tap 1 and on the connector 7. Descending during the screwing phase, the connector 7 will get in operating seal with the inventive tap 1 due to the OR-ring 13 on the internal wall of the first opening 4.5 of the main body 4. Simultaneously, the central pin 3 which, differently from the Rapak's tap shown in FIGS. 18 and 19, will be an always fixed element of the application, will push onto the internal peg 8 of the connector 7, and in particular on its surface 8.1, generating the opening at a certain height computed when designing. Simultaneously, the external surface of the plane 10.1 inside the connector 10.1 will push onto the end elements 5.2 of the control member 5, moving the outside of the dome-type valve 6 to which it is operatively constrained due, as previously seen, to the groove elements 5.1 and the tooth elements 6.1.

The flexible, membrane-type elastic valve 6, in turn, is connected to the central fixed pin 3 by means of the sealing elements 6.3 and the anchoring elements 3.1, making the elastic dome element 6 generate, from the coupling, the necessary force to close again the assembly of the inventive tap 1, after having removed the connector 7.

Obviously, there is the chance, by changing the elements of the various pieces, to create variations to the inventive tap 1, which always fall within the scope of the present invention.

Figure 15:
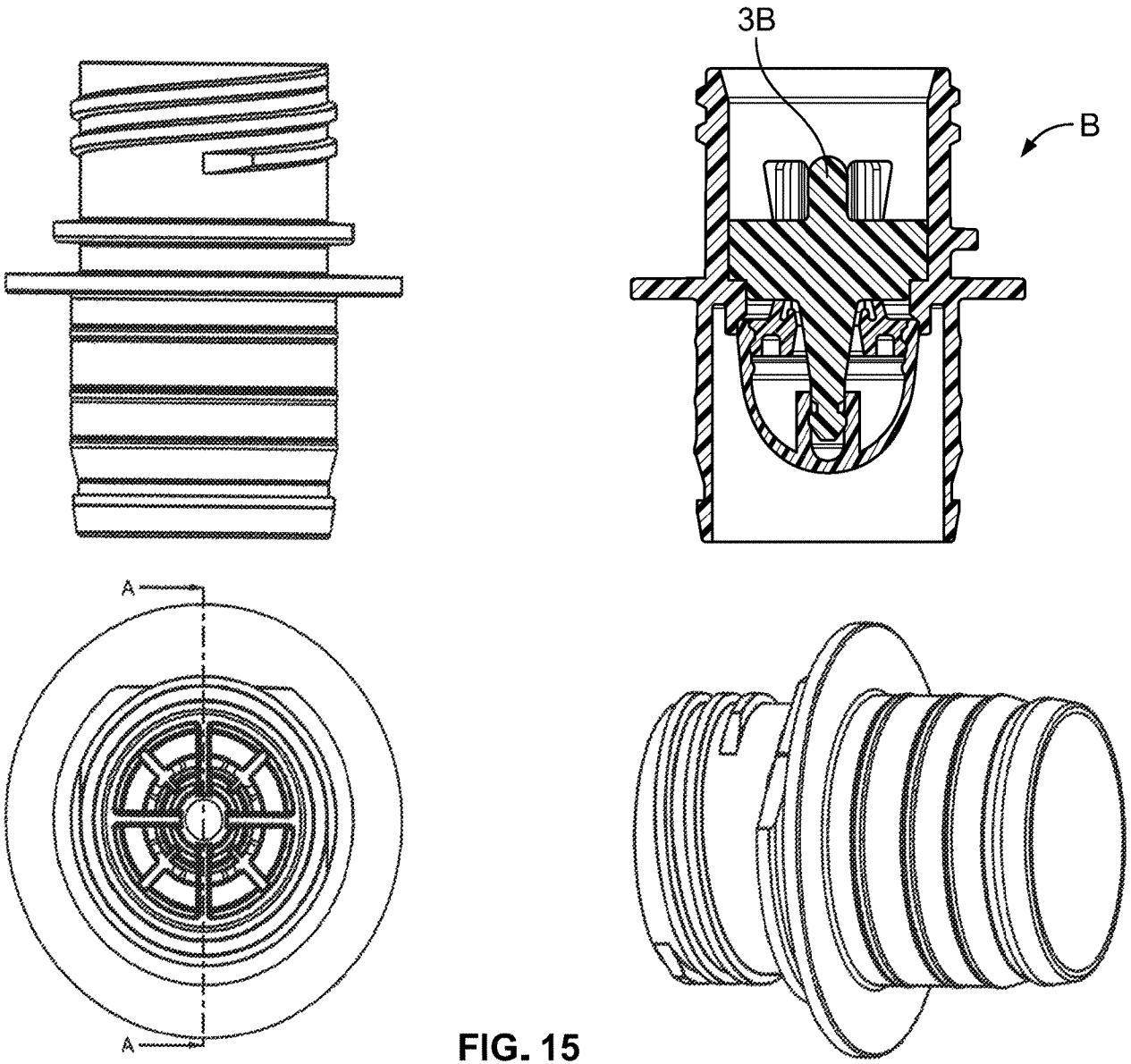
FIG. 15 shows a series of views of the inventive tap manufactured with a different configuration B, but which can always be associated with the inventive tap in different positions and with different details.

FIG. 15 shows version B of the inventive tap 1. In this version, an assembly equivalent to the inventive tap 1 has been made by geometrically changing the pieces.

In this version, the central fixed pin 3, the connecting ribs 4.9 of the central cylinder and the central cylinder 4.10 of the tap 1 have been aggregated in a single central piece 3B and then uncoupled or separated from the supporting body 4. In this case, there will be an equivalent tap to the previous tap 1, but with less pieces to be assembled and moulded, with consequent decrease of the production costs.

Figure 16:
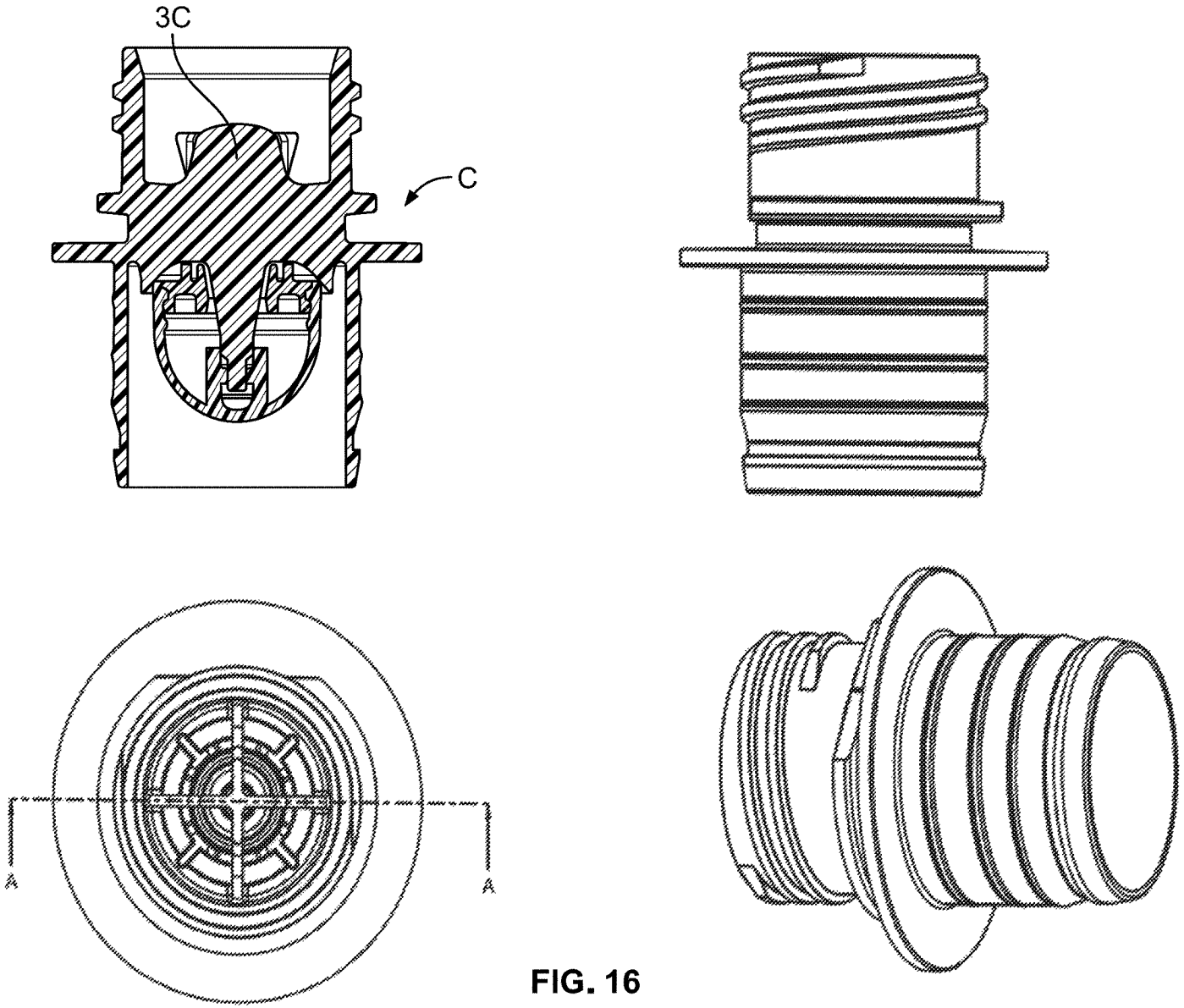
FIG. 16 is a series of views of the inventive tap manufactured with a different configuration C, but which can always be associated with the inventive tap in different positions and with different details.
Figure 17:
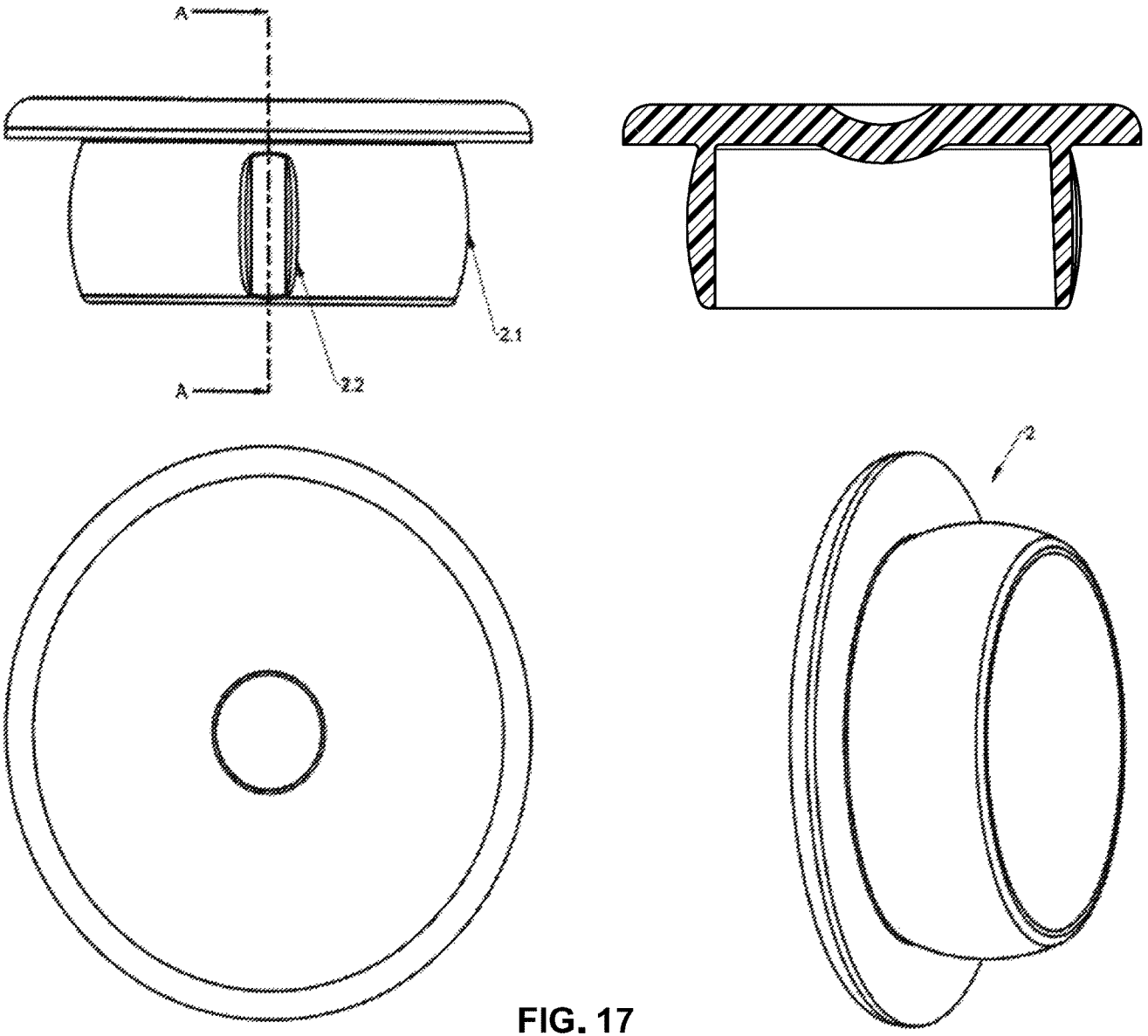
FIG. 17 is a series of views of an upper closing element of the inventive tap in different positions and with different details.

FIG. 16 shows the inventive tap 1 in a version C equivalent to the version B described above. In particular, FIG. 16 shows a version equipped with a body formed from a single piece in which the supporting body 4 has been integrated into the central piece 3B.

Figure 18:
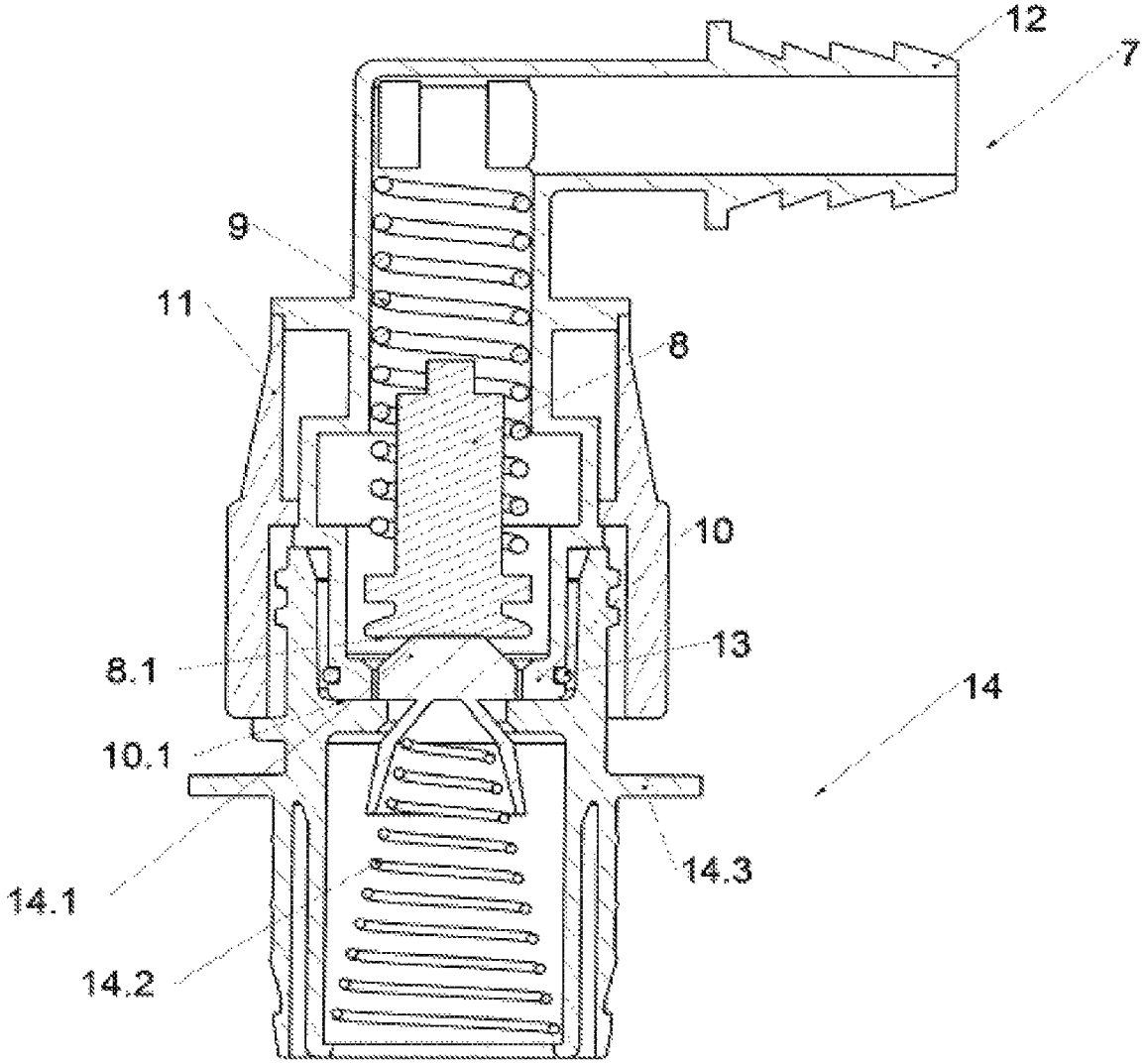
FIG. 18 is the side sectional view of a known type manufactured by company Rapak and supplied to company Britvic UK in an operating position.
Figure 19:
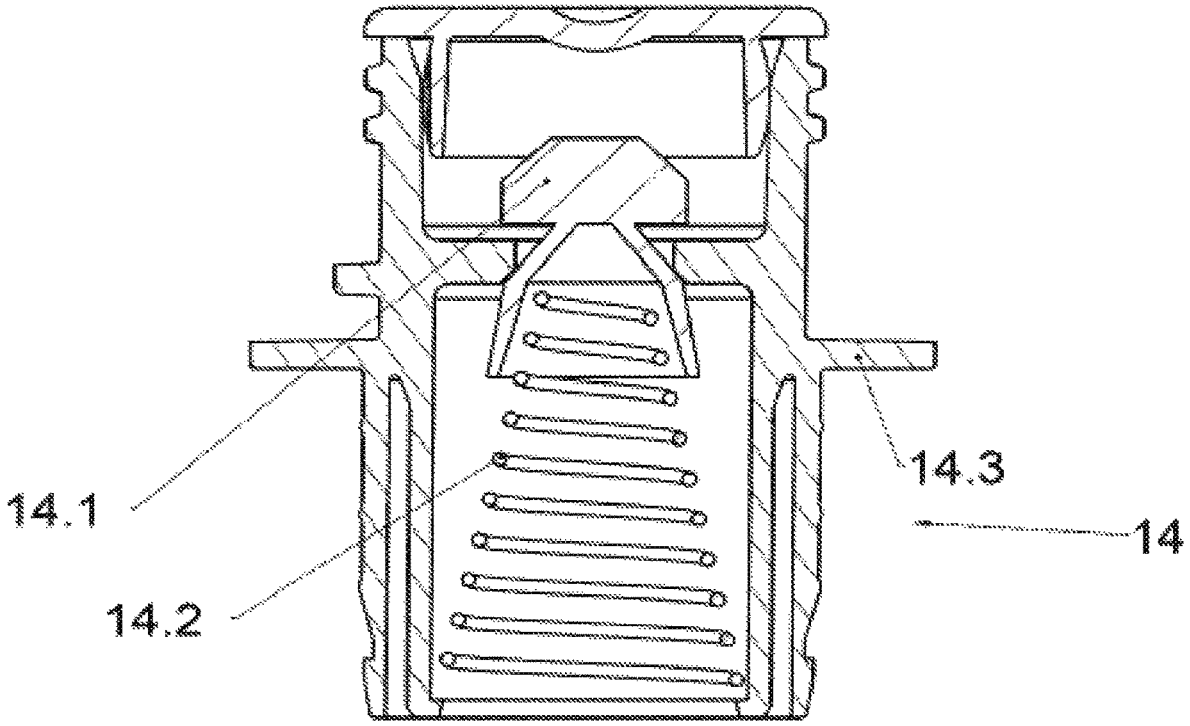
FIG. 19 is the side sectional view of the known type manufactured by company Rapak UK in its closing position with plug.

With the inventive tap 1, the problem of the metallic spring, not present any more, has been solved. The tap 1, being completely made of plastics, is recyclable and eco-compatible. The arrangement of the inventive tap 1 with fixed pin or central pin 3 and movement stem 5, preferably with four arms, constrained to the dome-type elastic valve 6 (which in turn is constrained to the central pin 3) makes the passage of liquid, which is created when the tap is in its opening position (FIG. 9), larger with respect to the tap manufactured by Rapak (FIGS. 18 and 19).

Figure 3:
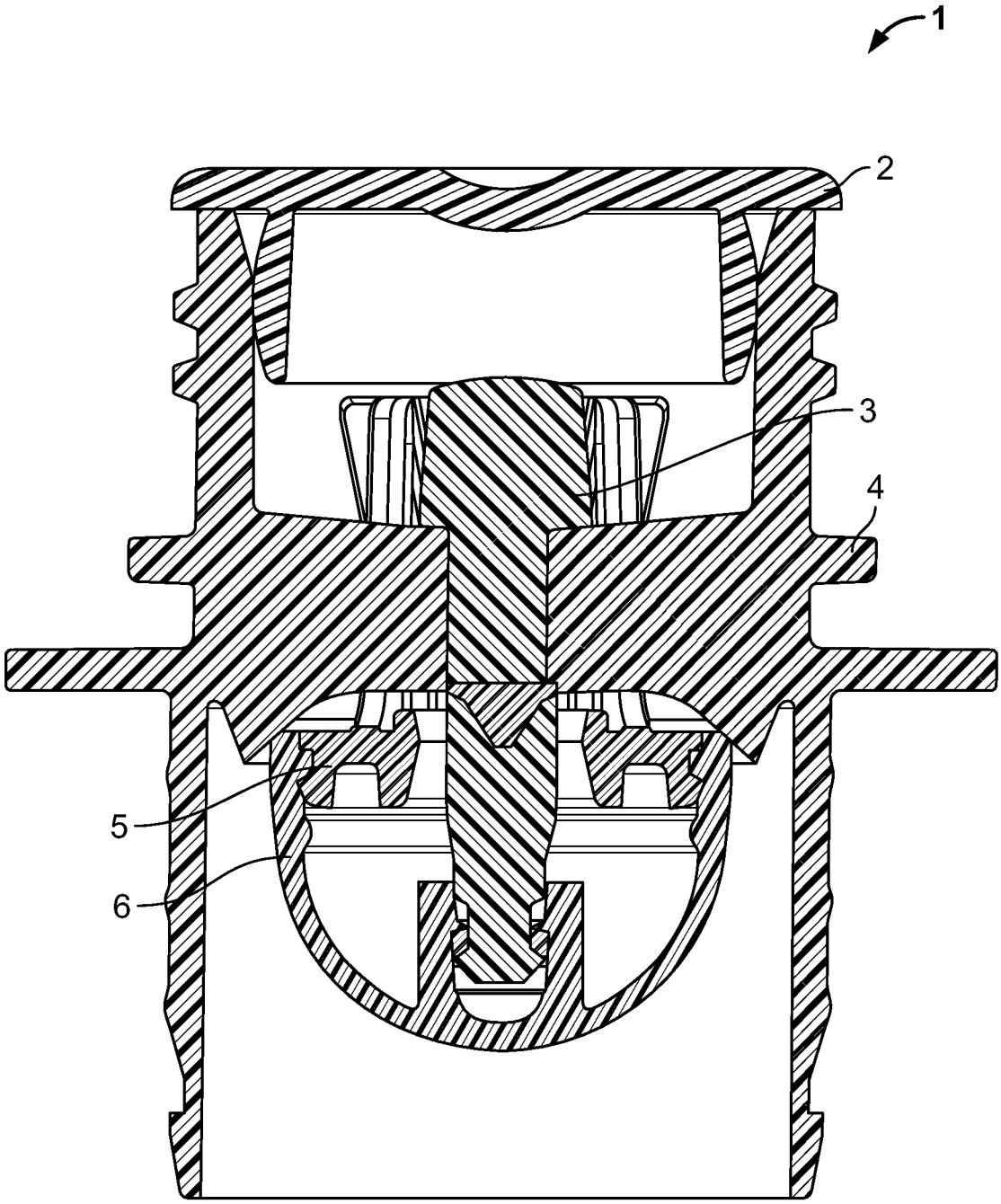
FIG. 3 is a sectional view of the assembled tap of FIG. 1.
Figure 4:
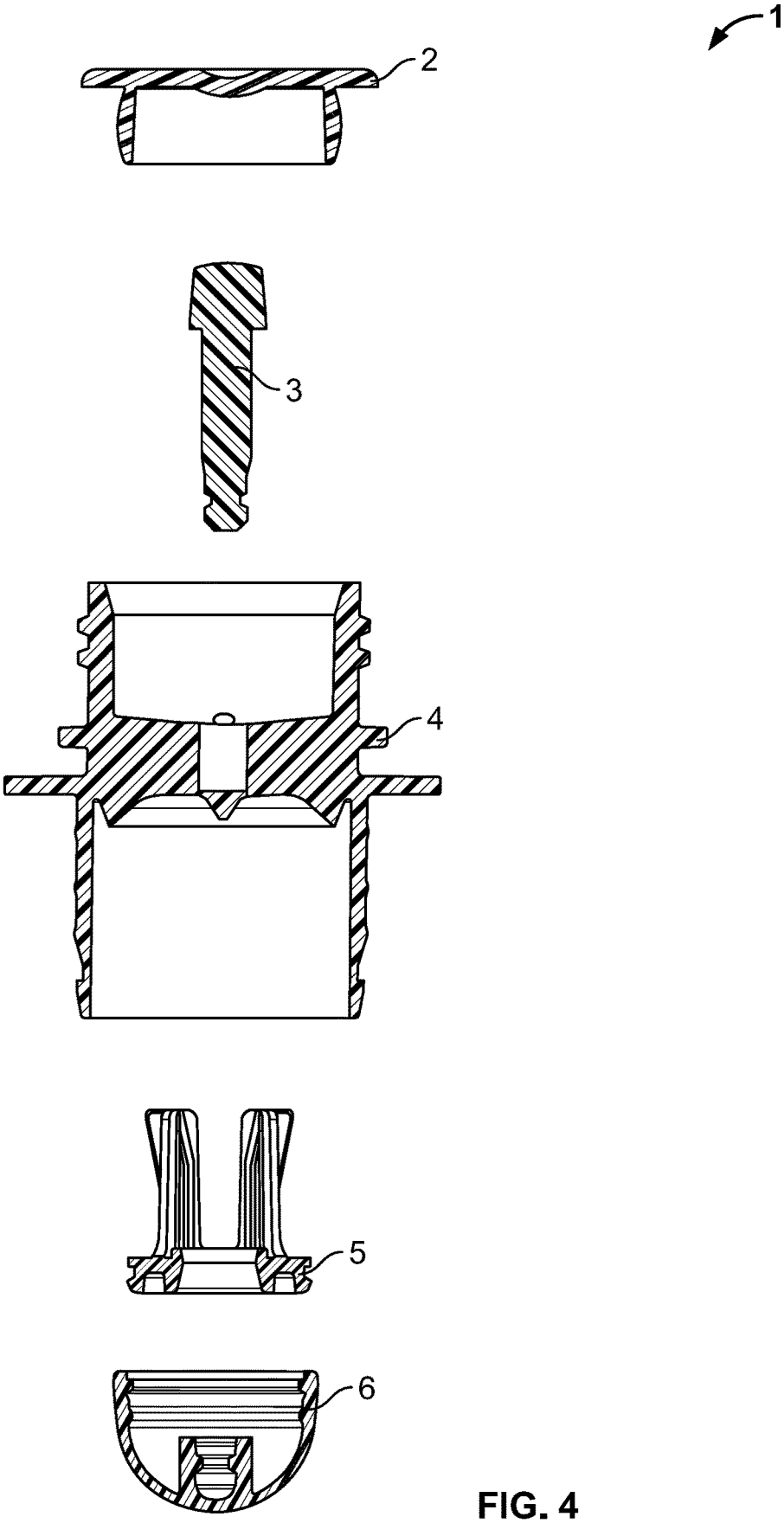
FIG. 4 is an exploded sectional view of the inventive tap of FIG. 1.
Figure 5:
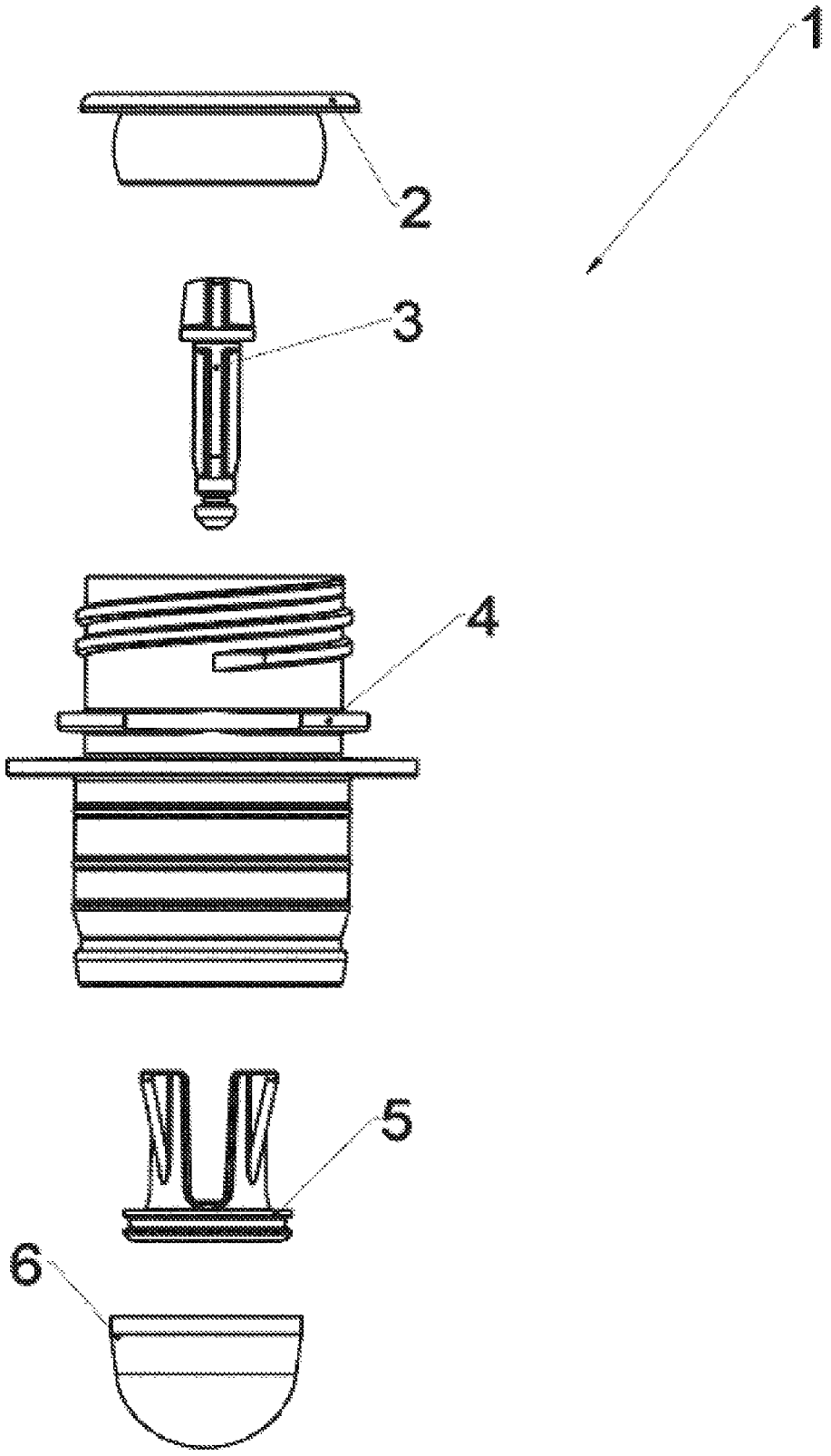
FIG. 5 is an exploded view of the inventive tap of FIG. 1.
Figure 6:
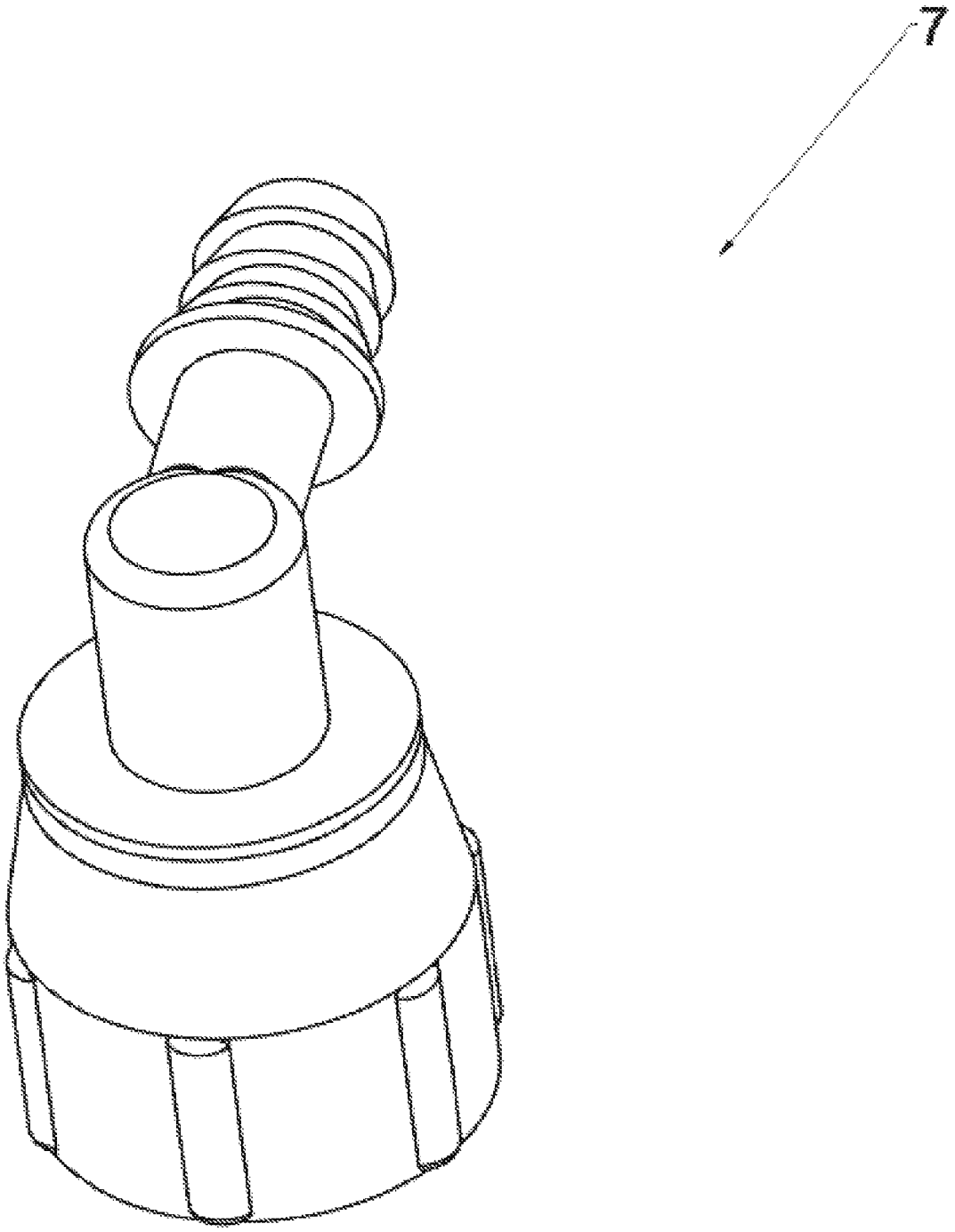
FIG. 6 is a perspective view of a connector present on the market.
Figure 7:
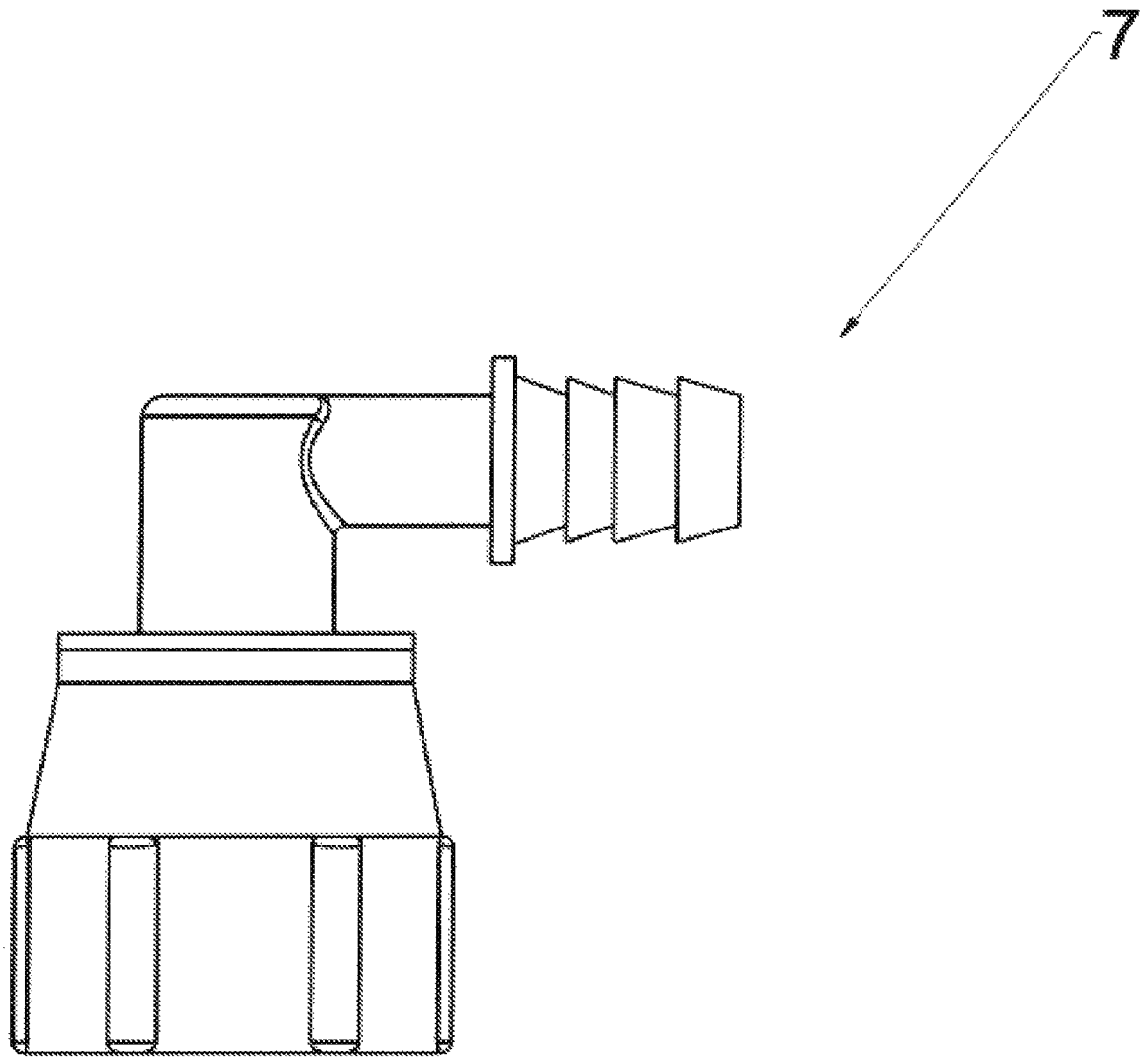
FIG. 7 is a side view of a connector present on the market.
Figure 8:
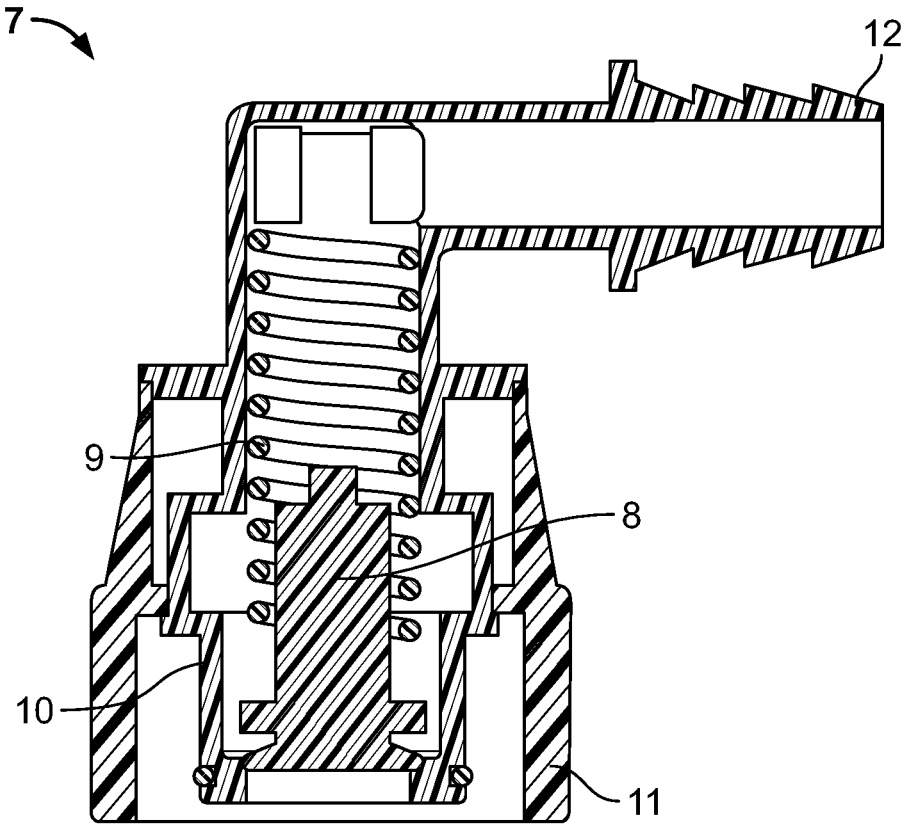
FIG. 8 is a sectional view of a connector present on the market to which one must adapt.

Taking into account FIG. 3, it is noted that the members for moving and automatically returning the dome-type elastic valve 6 and the movement stem 5 occupy the major part of the space of the rear part of the tap. This arrangement allows providing less space for air, and thereby consequently such space decrease for air present on the back of the tap (which is the one which will get in contract with liquid when the inventive tap 1 will be connected to the mouth, not shown) will coincide with less air inserted in the bag after its filling, and less risk of oxidation with respect to the solution from Rapak, where the rear space is free (occupied only by the metallic spring), but the rest of the volume is occupied by air which will enter the bag and oxidize the liquid contained therein.

We claim:

1. A tap for delivering liquids from a container, comprising:

a supporting body comprising at an end thereof fitting means with a container, the supporting body further comprising a first opening for making liquid go out, and connecting means adapted to be connected to connecting means present on a connector;

a central pin fixedly connected to a central element of the supporting body and comprising at an end thereof a fastening element and at an opposite end an abutment element for opening the connector when the connector is connected to the tap;

wherein the tap is completely made of plastic material, and further comprises:

a membrane elastic sealing valve connected to the fastening element of the central pin, adapted to allow automatically closing the tap and to perform an operating sealing of the same with the main body;

a control member connected to the elastic sealing valve for opening and closing the tap, the control member being adapted to be actuated through a thrust of the connector on end elements with which the control member is equipped, to open the tap transmitting a force to the valve connected to the control member.

2. The tap of claim 1, comprising connecting ribs adapted to mechanically support the central element of the supporting body.

3. The tap of claim 2, wherein the central pin, the connecting ribs and the central element are aggregated in a single piece separated from the supporting body.

4. The tap of claim 2, wherein the central pin, the connecting ribs and the central element are aggregated in a single piece integrated in the supporting body.

5. The tap of claim 2, wherein the membrane elastic sealing valve is a dome valve comprising a sealing element connected to the fastening element of the central pin, and a tooth element connected to a groove element of the control member, the membrane elastic sealing valve further comprising an external element adapted to be coupled with an area of the supporting body having a with slanted wall.

6. The tap of claim 2, wherein the control member is equipped with a flexible element with arms at whose ends there are the end elements, every single arm being equipped with a projection adapted to abut onto a plane of the connector for opening the tap.

7. The tap of claim 2, wherein an outer surface of the supporting body comprises a disk and an element for orienting the tap.

8. The tap of claim 2, wherein the supporting body is equipped at an end thereof with fitting means with the container and is adapted to be closed, at an opposite end, with a plug.

9. The tap of claim 2, wherein the connecting means are a threading.

10. The tap of claim 2, wherein the connecting ribs are arranged as a cross.

* * * * *